US012247560B2

(12) United States Patent
Nakamura et al.

(10) Patent No.: US 12,247,560 B2
(45) Date of Patent: Mar. 11, 2025

(54) PUMP UNIT AND PUMP, AND METHOD FOR DETECTING CHARACTERISTICS OF CONVEYANCE ARTICLE

(71) Applicant: CHUO UNIVERSITY, Hachioji (JP)

(72) Inventors: Taro Nakamura, Tokyo (JP); Yasuyuki Yamada, Tokyo (JP); Kota Wakamatsu, Tokyo (JP); Daiki Hagiwara, Tokyo (JP); Haruka Adachi, Tokyo (JP); Daisuke Matsui, Tokyo (JP)

(73) Assignee: CHUO UNIVERSITY, Hachioji (JP)

( * ) Notice: Subject to any disclaimer, the term of this patent is extended or adjusted under 35 U.S.C. 154(b) by 177 days.

(21) Appl. No.: 17/788,453

(22) PCT Filed: Dec. 16, 2020

(86) PCT No.: PCT/JP2020/046850

§ 371 (c)(1),
(2) Date: Jun. 23, 2022

(87) PCT Pub. No.: WO2021/131929

PCT Pub. Date: Jul. 1, 2021

(65) Prior Publication Data

US 2023/0034441 A1 Feb. 2, 2023

(30) Foreign Application Priority Data

Dec. 27, 2019 (JP) ..... 2019-238223

(51) Int. Cl.
*F04B 43/113* (2006.01)
*F04B 43/08* (2006.01)
*F04B 49/06* (2006.01)

(52) U.S. Cl.
CPC ..... *F04B 43/113* (2013.01); *F04B 49/065* (2013.01); *F04B 43/088* (2013.01)

(58) Field of Classification Search
CPC ..... F04B 43/113; F04B 43/12; F04B 43/088; F04B 49/065
See application file for complete search history.

(56) References Cited

U.S. PATENT DOCUMENTS 6,733,252 B2 * 5/2004 Feygin ..... B67D 7/62 417/478
6,871,551 B2 * 3/2005 Beller ..... F04B 49/065 73/861

(Continued)

FOREIGN PATENT DOCUMENTS

CN 105121027 A 12/2015
JP H055480 A * 1/1993

(Continued)

OTHER PUBLICATIONS

English Machine Translation of JPH055480A (Year: 1993).*

(Continued)

*Primary Examiner* — Nathan C Zollinger
(74) *Attorney, Agent, or Firm* — Oliff PLC

(57) ABSTRACT

A pump unit and a pump capable of detecting characteristics of a conveyance article and a method for detecting the characteristics of the conveyance article. A pump unit includes an outer cylinder; an inner cylinder disposed on an inner circumference side of the outer cylinder; and a pressure supply chamber provided between the inner cylinder and the outer cylinder, the pump unit being configured to convey a conveyance article in the inner cylinder by supplying a pressurizing medium into the pressure supply chamber and thereby causing the inner cylinder to expand inwardly in a radial direction, in which the pump unit further includes a conveyance article information acquiring device configured to acquire information on the conveyance article in the inner cylinder at a time when the inner cylinder is expanded.

9 Claims, 5 Drawing Sheets

(56) References Cited

U.S. PATENT DOCUMENTS

| | | | | |
|---|---|---|---|---|
| 7,806,668 | B2 * | 10/2010 | Yajima | F04B 43/10 417/474 |
| 9,745,148 | B2 * | 8/2017 | Mauchle | B65G 53/66 |
| 10,400,760 | B2 | 9/2019 | Sasa et al. | |
| 10,975,973 | B2 * | 4/2021 | Nakamura | F16K 7/07 |
| 2002/0001527 | A1 | 1/2002 | Beller et al. | |
| 2016/0122138 | A1 | 5/2016 | Mauchle et al. | |
| 2023/0034441 | A1 * | 2/2023 | Nakamura | F04B 43/12 |
| 2024/0209847 | A1 * | 6/2024 | Arnold | F04B 43/073 |

FOREIGN PATENT DOCUMENTS

| | | | | |
|---|---|---|---|---|
| JP | 2007154767 | A | * | 6/2007 |
| JP | 2013-174140 | A | | 9/2013 |
| JP | 2016-084719 | A | | 5/2016 |

OTHER PUBLICATIONS

English Machine Translation of JP-2007154767-A (Year: 2007).*
Feb. 22, 2021 International Search Report issued in International Patent Application No. PCT/JP2020/046850.
Jun. 28, 2022 International Preliminary Report on Patentability issued in International Patent Application No. PCT/JP2020/046850.
Apr. 30, 2024 Search Report issued in Chinese Patent Application No. 2020800903929.

* cited by examiner

FIG. 2B A-A CROSS SECTION

PUMP UNIT AND PUMP, AND METHOD FOR DETECTING CHARACTERISTICS OF CONVEYANCE ARTICLE

TECHNICAL FIELD

The present invention relates to a pump unit and a pump, and a method for detecting characteristics of a conveyance article.

BACKGROUND ART

In recent years, as shown in Patent Document 1, there has been known a pump unit which is configured such that an inner cylinder is provided inside a cylindrical outer cylinder so as to form a double-tube structure, fluid such as air is supplied into an annular chamber formed between the outer cylinder and the inner cylinder, and the inner cylinder is made to be expandable inwardly in a radial direction, and a conveyance article is conveyed by virtue of a volume change in the inner cylinder caused by the expansion of the inner cylinder. Such a pump unit is used as a conveyance device with either a single pump unit or a plurality of pump units connected to each other. In a case where the plural pump units are connected, conveyance of the conveyance article is carried out, in imitation of the peristaltic motion of human intestines for example, by sequentially expanding the inner cylinder of each of the connected pump units.

CITATION DOCUMENT

Patent Document

Patent Document 1: Japanese Unexamined Patent Application Publication No. 2013-174140.

SUMMARY OF THE INVENTION

Technical Problem

However, with the above-mentioned pump unit, there may a case where conveyance is difficult depending on a conveyance article. For example, in a case where the conveyance article is a liquid or a solid-liquid mixture with high fluidity (low viscosity) or the like, the conveyance article can be conveyed easily hut, in a case where the conveyance article is the solid-liquid mixture with high viscosity or the like, conveyance of the conveyance article may be difficult. Hence, in order to improve a conveyance efficiency, it is necessary to know characteristics of the conveyance article, such as presence of the fluidity and so on.

Accordingly, the present invention aims at providing a pump unit and a pump capable of detecting characteristics of the conveyance article, and a method for detecting the characteristics of the conveyance article.

Solution to Problem

As a configuration of a pump unit for solving the above-mentioned problem, there is provided a pump unit including an outer cylinder, an inner cylinder disposed on an inner circumference side of the outer cylinder, and a pressure supply chamber provided between the inner cylinder and the outer cylinder, the pump unit being configured to convey a conveyance article in the inner cylinder by supplying a pressurizing medium into the pressure supply chamber and thereby causing the inner cylinder to expand inwardly in a radial direction, in which the pump unit further includes a conveyance article information acquiring means configured to acquire information on the conveyance article in the inner cylinder at a time when the inner cylinder is expanded.

According to this configuration, it is possible to acquire the information on the conveyance article for detection of characteristics of the conveyance article.

The pump unit may be configured such that the conveyance article information acquiring means includes a flow rate measuring means configured to measure a flow rate of the pressurizing medium to be supplied to the pressure supply chamber, and a pressing force measuring means configured to measure a pressing force of the inner cylinder pressing the conveyed article caused by supply of the pressurizing medium to the pressure supply chamber.

Further, as a configuration of a pump for solving the above-mentioned problem, there is provided a pump having the pump unit as claimed in claim 1, which may include a supply/discharge control means configured to control supply and discharge of the pressurizing medium to and from the pump unit and a conveyance article information processing means configured to determine characteristics of the conveyance article on the basis of the information on the conveyance article acquired by the conveyance article information acquiring means, or a pump having the pump unit as claimed in claim 2, which may include a supply/discharge control means configured to control supply and discharge of the pressurizing medium to and from the pump unit and a conveyance article information processing means, the conveyance article information processing means including a volume calculating means configured to calculate a volume of the conveyance article in the inner cylinder on the basis of the flow rate of the pressurizing medium measured by the flow rate measuring means and the pressure of the inner cylinder pressurizing the conveyance article, which is measured by the pressing force measuring means and a characteristic determining means configured to determine characteristics of the conveyance article on the basis of the volume calculated by the volume calculating means.

According to this configuration, it is possible to detect the characteristics of the conveyance article. For example, by calculating the volume of the conveyance article in the pump unit at the time of expansion, the characteristics of the conveyance article can be detected.

The pump may be provided with a conveyance abnormality detecting means configured to detect a conveyance abnormality on the basis of the information on the conveyance article acquired by the conveyance article information acquiring means, or the supply/discharge control means may be configured to control operations of a plurality of pump units, on the basis of the abnormality detected by the conveyance abnormality detecting mean, so as to resolve the detected abnormality, or the supply/discharge control means may be configured to control the operations of the plurality of pump units, on the basis of the characteristics of the conveyance article determined by the conveyance article information processing means, so as to be able to optimize the conveyance of the conveyance article and improve the conveyance efficiency.

Further, the conveyance article information processing means may be configured to select, on the basis of the information on the conveyance article input from the conveyance article information acquiring means provided in each pump unit, control by the supply/discharge control means of the operation for resolving the abnormality of the plurality of pump units, or control of the operations, based on the determined characteristic of the conveyance article, of the plurality of pump units, and output the selected content to the supply/discharge control means.

Furthermore, as an aspect of a method for detecting characteristics of a conveyance article, there is provided a method for detecting characteristics of a conveyance article conveyed by a pump unit which includes an outer cylinder, an inner cylinder disposed on an inner circumference side of the outer cylinder and a pressure supply chamber provided between the inner cylinder and the outer cylinder, the pump unit being configured to convey the conveyance article in the inner cylinder by supplying a pressurizing medium into the pressure supply chamber and thereby causing the inner cylinder to expand inwardly in a radial direction, in which the method includes calculating a volume of the conveyance article in the inner cylinder at a time when the inner cylinder is expanded, and detecting the characteristics of the conveyance article on the basis of the calculated volume.

According to this aspect, by calculating the volume of the conveyance article in the inner cylinder at the time when the inner cylinder is expanded, the characteristics of the conveyance article can be detected.

Furthermore, the volume may be calculated on the basis of a pressure of the inner cylinder pressurizing the conveyance article and a flow rate to the pressure supply chamber.

BRIEF DESCRIPTION OF THE DRAWINGS

FIGS. 2A to 2C are cross sectional views of a pump unit in an axial direction and in a radial direction.

Hereinafter, the present invention will be described in detail through embodiments of the invention; however, the following embodiments are not intended to limit the inventions set forth in the claims, and all of combinations of the features described in the embodiments are not necessarily essential to the solving means of the invention, but selectively adopted configurations are included.

DESCRIPTION OF EMBODIMENTS

Figure 1:
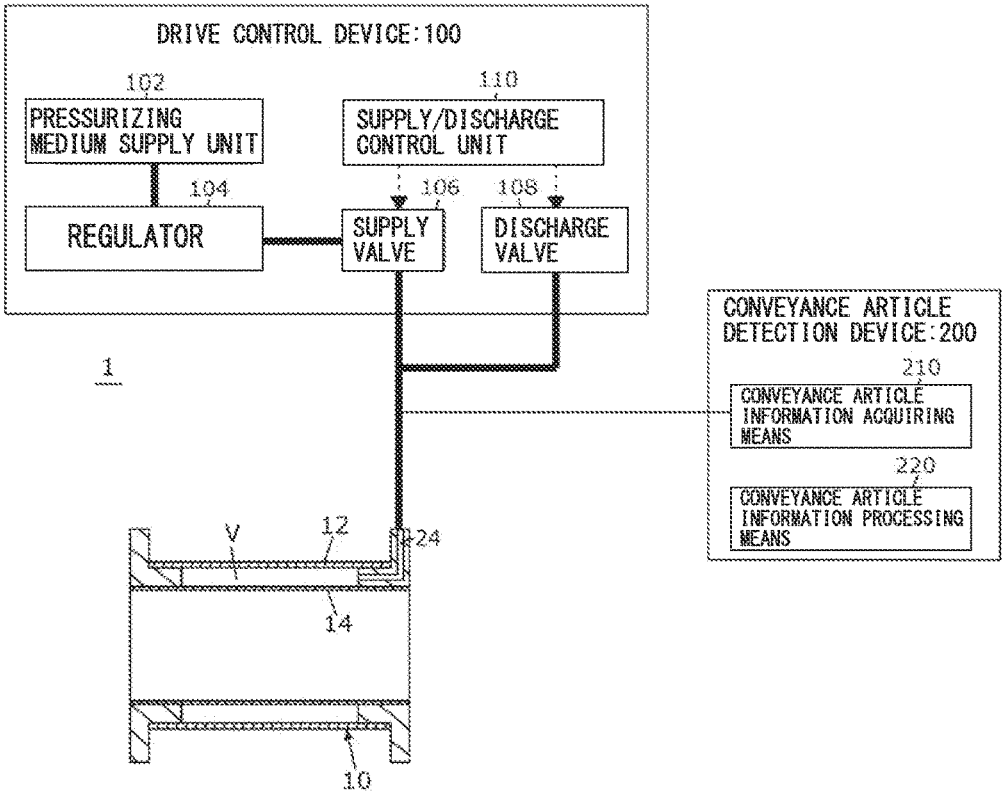
FIG. 1 is a schematic block diagram of a pump.

FIG. 1 is a schematic block diagram illustrating an embodiment of a pump 1, As illustrated in FIG. 1, the pump 1 according to this embodiment is provided roughly with a pump unit 10 that functions as a conveyance unit for conveying an article to be conveyed (hereinafter referred to as "conveyance article"), a drive control device 100 that controls the operation of the pump unit 10 and a conveyance article detection device 200 that detects information on the conveyance article.

The pump unit 10 is used to be disposed, as a single unit or as being connected in plural numbers, in the middle of an existing piping, to be disposed directly as the piping by being connected in the plural numbers, or to be connected to an outlet of a supply source of the conveyance article. In the following, explanations will be given using a case where the number of pump units 10 is one which is the minimum unit for the pump 1 to operate.

Figure 2A:
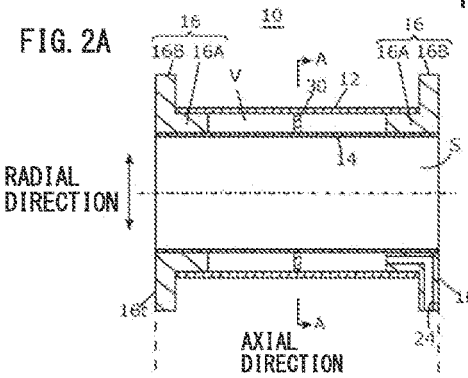
Figure 2A:
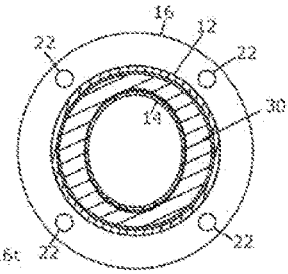
Figure 2C:
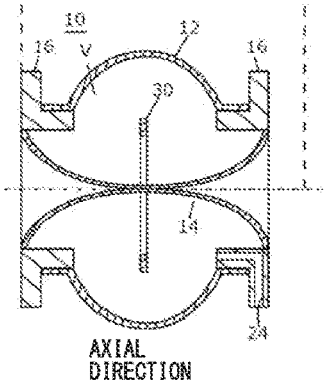

FIGS. 2A to 2C are cross-sectional views of the pump unit 10 in an axial direction and in a radial direction. As illustrated in FIGS. 2A to 2C, the pump unit 10 is provided with an outer cylinder 12, an inner cylinder 14 disposed on an inner circumference side of the outer cylinder 12 so as to form a double tube with the outer cylinder 12, and a pair of end rings 16; 16 that close both ends of the outer cylinder 12 and of the inner cylinder 14 so as to form an airtight chamber V between the outer cylinder 12 and the inner cylinder 14.

The outer cylinder 12, the inner cylinder 14 and the end rings 16; 16 are the minimum configuration elements that form the pump unit 10.

The outer cylinder 12 according to this embodiment is formed as a cylindrical body made of an elastic member which allows expansion and contraction while maintaining airtightness. The outer cylinder 12 is formed, for example, inclusive of a rubber material and a fiber material, and so formed that, in the sectional view in the radial direction, the outer cylinder 12 has rubber layers and a fiber layer in which plural fiber materials are layered between the rubber layers. Each fiber forming the fiber layer has a length, for example, extending continuously from one end side to the other end side of the outer cylinder 12, and disposed so as to extend along the axial direction of the outer cylinder 12.

Incidentally, as the disposing form of the fibers in the outer cylinder 12, the fibers are not necessarily included in the layer shape, but may be dispersedly buried in the rubber material.

For the rubber material forming the rubber layer, for example, low ammonia natural latex rubber, silicone rubber, synthesis rubber or the like may be used.

Further, for the fiber material forming the fiber layer, a high elastic fiber with a small elastic change in the axial direction is preferable. For example, a fiber having non-extensibility such as an aramid fiber, a carbon fiber, a glass fiber, a nylon, a polyamide-based fiber, a polyolefin-based fiber, a metal fiber or the like may be suitably selected and used. The fiber can be sufficiently improved in terms of its adhesiveness by performing a suitable primer treatment or a suitable surface oxidization treatment, however, it is preferable to select the fiber in accordance with the adhesivity to the rubber material.

As a form of the fiber material, any form such as filament, yarn span yarn and filament yarn), strand or the like may be used, and moreover, it is also possible to use untwisted fibers converged without having being twisted, and fibers made by twisting a plurality of numbers of these untwisted fibers. Depending on the type of the fiber, fibers of different materials of two or more types or fibers of different forms may be combined together.

The length of the fiber is not limited to the length continuing from one end side to the other end side, it may be configured such that plural fibers, which are shorter than the length in the axis direction of the outer cylinder 12, are distributed continuously along the axis direction so as to reach from the one end side to the other end side.

The inner cylinder 14 is formed as a cylinder body made of elastic member which allows expansion and contraction while maintaining the airtightness. The inner cylinder 14 is formed, for example, of a rubber material. A space on the inner circumferential side of the inner cylinder 14 is a conveyance path S for conveying the conveyance article. For the rubber material forming the inner cylinder 14, any of rubber materials, for example, the natural latex rubber, the silicone rubber, the synthesis rubber or the like, that was used for forming the outer cylinder 12, may be used.

Similar to the outer cylinder 12, the inner cylinder 14 may be formed to contain fibers, and extension toward the axial direction may be restricted in a case where the inner cylinder 14 is about to be expanded due to the introduction of air into the airtight chamber V.

A pair of end rings 16; 16 are provided with cylindrical sections 16A; 16A, and flat disk-shape flange sections 16B; 16B formed at one end side of the cylindrical sections 16A; 16A to have a diameter larger than an outer diameter of the cylindrical sections 16A; 16A.

On the outer circumference side of the cylindrical sections 16A; 16A, the inner circumference of the outer cylinder 12 is inserted and fixed by a not-shown fixing means so as to maintain the airtight state between the outer circumferential surfaces of the cylindrical sections 16A; 16A and the inner circumferential surface of the outer cylinder 12.

On the inner circumferential side of the cylindrical sections 16A; 16A, each end of the inner cylinder 14 is inserted and fixed by a not-shown fixing means so as to maintain the airtight state between the inner circumference of the cylindrical sections 16A; 16A and the outer circumference of the inner cylinder 14. Fixation of the inner cylinder 14 to the cylindrical section 16A may preferably be done in such a manner that the end part of the inner cylinder 14 is placed as much close to end faces 16*t*; 16*t* of the end rings 16; 16.

As illustrated in FIG. 2B, the flange sections 16B; 16B are provided with connecting sections 22 which allow connection of the pump units 10 to each other. The connecting section 22 is provided, for example, as a hole penetrating in a thickness direction of the flange 16B, in plural numbers at equal intervals along the circumferential direction outwardly in the radial direction of the outer cylinder 12. With this configuration, it is possible to connect the pump units 10 mutually with the use of fastening means such as bolts and nuts and to connect with piping or the like of a supply source of the conveyance article.

By closing the both ends of the outer cylinder 12 and of the inner cylinder 14 by the pair of end rings 16; 16 in this manner, the airtight chamber V enclosed by the outer cylinder 12, the inner cylinder 14 and the pair of end rings 16; 16 is formed in the pump unit 10.

As illustrated in FIG. 2A, one end ring 16 is provided with a supply/discharge section 24 for supplying and discharging the pressurizing medium to and from the airtight chamber V.

The supply/discharge section 24 is provided, for example, as a hole which opens at one end thereof to the outer circumferential surface of the flange section 16B, extends within the end ring 16, and opens at the other end thereof between the outer cylinder 12 and the inner cylinder 14 that are fixed to the cylindrical section 16A. A tube extending from a drive control device 100 described later is connected to the supply/discharge section 24 to supply and discharge the pressurizing medium to and from the airtight chamber V (See FIG. 1).

In the pump unit 10, by supplying the pressurizing medium to the airtight chamber V, the outer cylinder 12 expands outwardly in the radial direction and the inner cylinder 14 expands inwardly in the radial direction (centripetal direction). With this expansion, because the outer cylinder 12 is provided with the fibers extending in the axial direction, when the outer cylinder 12 is about to expand, the extension (expansion) in the axial direction is restrained by the fibers, and only the expansion outwardly in the radial direction is allowed and the outer cylinder 12 contracts in the axial direction.

Further, in the pump unit 10, by discharging the pressurizing medium from the airtight chamber V, the outer cylinder 12 contracts inwardly in the radial direction and the inner cylinder 14 contracts outwardly in the radial direction (the centripetal direction) and extends in the axial direction.

Namely, the pump unit 10 functions, by supplying and discharging the pressurizing medium to and from the airtight chamber V formed by the outer cylinder 12, the inner cylinder 14 and the pair of end rings 16; 16, as an expansion/contraction member that expands and contracts in the axial and in the radial direction as described above.

The conveyance article in the inner cylinder 14 of the pump unit 10 is pushed out toward outside of the inner cylinder 14 by the pressurizing force resulting from the expansion of the inner cylinder 14 and by the contraction toward the axial direction. That is, the airtight chamber V functions as a pressure supply chamber for applying the pressure to the conveyance article by the inner cylinder 14 and pushing out the conveyance article from inside the inner cylinder 14.

The airtight chamber V is provided with a shaper ring 30 for facilitating and stabilizing the expansion of the inner cylinder 14 when the pressurizing medium is supplied to the airtight chamber V The shaper ring 30 is a ring shape member which is disposed around the axis of the inner cylinder 14 and its inner diameter section is made to be an elliptic shape and its outer diameter section is made to be a circular shape. By positioning the inner cylinder 14 within the inner diameter of the shaper ring 30, the inner circumferential surface of the inner cylinder 14 correspondingly facing the short axis of the ellipse is previously made to be closer to the inner side in the radial direction than the inner circumferential surface of the inner cylinder 14 correspondingly facing the long axis of the ellipse. In other words, the shaper ring 30 functions as an expansion defining member that defines the shape of the inner cylinder 14 at the time of expansion.

As illustrated in FIG. 1, the drive control device 100 is provided with a pressurizing medium supply unit 102, a regulator 104, a supply valve 106, a discharge valve 108 and a supply/discharge control unit (supply/discharge control means) 110.

The pressurizing medium supply unit 102 is a device that increases the pressure of the pressurizing medium to a pressure required for expansion of the pump unit 10 and generates the pressurizing medium, for example, a compressor may be used. In other words, by using the compressor, air in the atmosphere is generated as compressed air and can be used as the pressurizing medium.

Incidentally, the pressurizing medium is not limited to the air, but may be any gas other than the air, and not limited to the gas, but may also be liquid such as water. In the following explanations, the pressurizing medium is described as the air (compressed air).

The regulator 104 is a device connected to the pressurizing medium supply unit 102 via the tube, for reducing to a predetermined pressure the pressure of the pressurizing medium supplied from the pressurizing medium supply unit 102, regulating the pressure to a certain level and supplying the regulated pressurizing medium to the pump unit 10. The pressurizing medium regulated by the regulator 104 is supplied to the supply valve 106 connected to the regulator 104 via the tube.

The supply valve 106 is connected to the pump unit 10 and controls the supply of the pressurizing medium regulated by regulator 104 to the pump unit 10 and stoppage of the supply.

The discharge valve 108 is disposed between the supply valve 106 and the pump unit 10 and discharges the pressurizing medium supplied to the pump unit 10. In this embodiment, the discharge valve 108 is configured to discharge the compressed air supplied to the pump unit 10 into the atmosphere.

For the supply valve 106 and the discharge valve 108, a solenoid valve which is operated by an electrical signal may be applied, for example. By using the solenoid valve for the supply valve 106 and the discharge valve 108, it is possible to improve a response speed of the time when expanding or contracting the pump unit 10.

The supply valve 106 and the discharge valve 108 are electrically connected to the supply/discharge control unit 110, and opening and closing of the valves are controlled on the basis of the signal input from the supply/discharge control unit 110. In this embodiment, the supply valve 106 and the discharge valve 108 are respectively in a closed state when no signal is input, and the valves are opened when the signal is input and closed when input of the signal is stopped.

The supply/discharge control unit 110 is a computer which is equipped with hardware such as a CPU as an arithmetic means, a ROM and a RAM as memory means, a communication interface as an input/output means and so on, and which, as the CPU executes the program stored in the memory means, controls opening and closing of the supply valve 106 and the discharge valve 108 connected to the supply/discharge control unit 110 to thereby control the expansion/contraction operations of the pump unit 10.

Specifically, the supply/discharge control unit 110 outputs the signal only to the supply valve 106, and by opening the supply valve 106, forces the pressurizing medium to flow into the airtight chamber V of the pump unit 10 so as to cause the pump unit 10 to expand, as illustrated in FIG. 2C.

Further, the supply/discharge control unit 110 stops, in the expansion process, output of the signal to the supply valve 106, and by closing the supply valve 106, maintains the expansion state of the pump unit 10.

Furthermore, the supply/discharge control unit 110 outputs, in the state in which the expansion stated of the pump unit 10 is maintained, the signal only to the discharge valve 108, and by opening the discharge valve 108, allows the pressurizing medium in the airtight chamber V to flow out to thereby cause the pump unit 10 to contract, as illustrated in FIG. 2A.

The pump unit 10 is restricted in terms of the extension in the axis direction as the fiber layers extending along the axis direction are provided in the outer cylinder 12. As a result, the expansion direction of the outer cylinder 12 is limited to outward in the radial direction, and along the expansion outward in the radial direction, the length in the axial direction is contracted. In addition, as to the inner cylinder 14, the inner circumferential surface of the inner cylinder 14, which correspondingly faces the short axis of the inner cylinder 14 at the center in the axis direction corresponding to the position of the shaper ring 30, precedingly starts to expand, due to the supply of the air into the airtight chamber inwardly in the radial direction (axial center direction), and glue to further supply of the air, the conveyance article in the inner cylinder 14 is conveyed toward the axial direction, and as illustrated in FIG. 2C, inside of the inner cylinder 14 is approximately completely blocked. Due to this expansion of the inner cylinder 14, the conveyance article in the inner cylinder 14 is pressurized by the inner cylinder 14, pushed out toward the axial direction and conveyed.

The conveyance article detection device 200 is provided with a conveyance article information acquiring means 210 and a conveyance article information processing means 220.

The conveyance article information acquiring means 210 is provided with a flow rate measuring means 212 and a pressing force measuring means 214, and acquires information on the conveyance article on the basis of the operation of the pump unit 10. The information on the conveyance article here refers to the characteristics of the conveyance article, such as fluidity (viscosity), hardness and so on, for example.

The flow rate measuring means 212 is disposed between the supply valve 106 and the pump unit 10 and measures the flow rate of the pressurizing medium supplied to the airtight chamber V at the time of expansion of the inner cylinder 14. For the flow rate measuring means 212, for example, a flow rate sensor capable of converting the measured flow rate into an electrical signal may be used. The flow rate measuring means 212 is electrically connected to the conveyance article information processing means 220 and outputs the measured flow rate to the conveyance article information processing means 220.

The pressing force measuring means 214 is disposed between the flow rate measuring means 212 and the pump unit 10 and measures the pressure of the pressurizing medium in the airtight chamber V. For the pressing force measuring means 214, for example, a pressure sensor capable of converting the measured pressure into an electrical signal may be used. The pressing force measuring means 214 is electrically connected to die conveyance article information processing means 220 and outputs the measured pressure to the conveyance article information processing means 220.

It should be noted that the position of the pressing force measuring means 214 may be anywhere as long as the pressure of the pressurizing medium the airtight chamber V can be measured.

By measuring the pressure of the pressurizing medium in this way, the pressing force of the inner cylinder 14 pressurizing the conveyance article can be measured indirectly.

The pressing force measuring means 214 is not limited to the above-mentioned pressure sensor, but may be any means which is capable of detecting the force of the inner cylinder 14 pressing the conveyance article. For example, it may be configured to directly detect, by attaching a piezoelectric element on the surface where the inner cylinder 14 contacts the conveyance article, the force of the inner cylinder 14 pressing the conveyance article, or it may be configured to measure, by using an acceleration sensor for example, stress and deformation of the inner cylinder 14 to thereby indirectly detect the force of the inner cylinder 14 pressing the conveyance article.

In the above-described embodiment, the explanation has been given such that the pressure of the inner cylinder 14 pressurizing the conveyance article at the time of expansion is measured by the pressure sensor as the pressure of the air in the airtight chamber V, but it is not limited to it. For example, it may be configured to directly detect, by providing a load sensor on the surface of the inner cylinder 14 so as to be in direct contact with the conveyance article, the pressurizing force (pressing force) of the inner cylinder 14 pressurizing the conveyance article in the process of expansion or at the time of the n maximum expansion of the inner cylinder 14, or it may be configured to measure a tension of the inner cylinder 14 at the time of expansion to thereby indirectly detect the pressure of the inner cylinder 14 pressurizing the conveyance article.

The conveyance article information processing means 220 is a computer, which is provided with hardware such as a CPU as an arithmetic means, a ROM and a RAM as memory means and so on, and which processes the information on the conveyance article on the basis of the information such as the flow rate and the pressure input respectively from the flow rate measuring means 212 and the pressing force measuring means 214. The conveyance article information processing means 220, when the CPU executes the program stored in the memory means, causes the conveyance article information processing means 220 to function as each means or each unit described later. The flow rate and the pressure input respectively from the flow rate measuring means 212 and the pressing force measuring means 214 are stored with time, for example, as a flow rate history and a pressure history, in the memory means.

Figure 3:
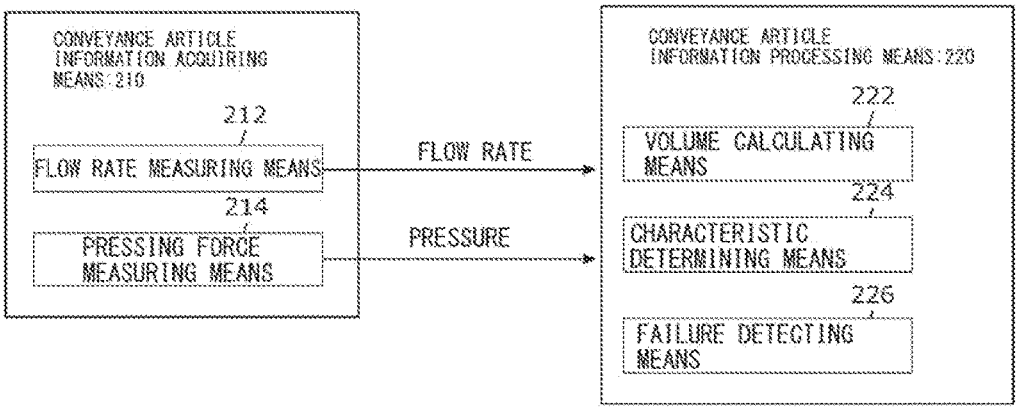
FIG. 3 is a block diagram illustrating configurations of a conveyance article information acquiring means and a conveyance article information processing means.

FIG. 3 is a block diagram illustrating the configuration of the conveyance article information processing means 220. In FIG. 3, the shaper ring 30 is omitted. As illustrated in FIG. 3, the conveyance article information processing means 220 is provided with a volume calculating means 222, a characteristic determining means 224 and a fault detecting means 226.

The volume calculating means 222 calculates a volume of the conveyance article contained in the inner cylinder 14 on the basis of the flow rate value and the pressure value input respectively from the flow rate measuring means 212 and the pressing force measuring means 214.

The volume of the conveyance article can be calculated, for example, by storing beforehand in the memory means a data map in which a relationship among the flow rate, the pressure and the volume of the conveyance article has been obtained, or by storing beforehand in the memory means a mathematical formula which enables calculation of the volume of the conveyance article by inputting the flow rate and the pressure.

The volume of the conveyance article is calculated, for example, as a volume change over time, each time the flow rate and the pressure are input. The calculated volume of the conveyance article is stored along with the time in the memory means.

The characteristic determining means 224 determines the characteristics of the conveyance article on the basis of the measured flow rate, the measured pressure and the calculated volume value. The characteristics of the conveyance article referred to in this embodiment are, for example, viscosity and hardness.

The viscosity can be determined on the basis of the volume change over time of the conveyance article. For example, in a case where the volume change over time is slow, the viscosity of the conveyance article can be determined to be high, and in a case where the volume change over time is fast, the viscosity of the conveyance article can be determined to be low.

Further, the hardness can be determined on the basis of the volume change over time of the conveyance article and the change of the pressure. For example, in a case where the change of the volume is slow and the change of the pressure is large, the conveyance article can be determined to be hard, and in a case where the change of the volume is fast and the change of the pressure is small, the conveyance article can be determined to be soft.

Incidentally, the characteristics of the conveyance article to be determined by the characteristic determining means 224 are not limited to the viscosity and the hardness, but may be any characteristics that can be determined on the basis of the measured flow rate, the measured pressure and the calculated volume.

The result determined by the characteristic determining means 224 may be, for example, arranged to be displayable on a not-shown display means or may be output to the drive control device 100.

The failure detecting means 226 detects, for example, on the basis of the flow rate and the pressure, presence or absence of the failure of the pump unit 10. That is, in a case where the pressure does not increase along with increase in the flow rate, the failure detecting means 226 can detect that air leak is occurring in the pump unit 10.

As described above, because the pump 1, which is configured by the pump unit 10 in which the expansion/contraction of the inner cylinder 14 is controlled by the drive control device 100, is provided with the conveyance article detection device 200, the characteristics of the conveyance article to be conveyed by the pump unit 10 can be detected. Thereby, it is possible to determine whether the conveyance by the pump unit 10 can be performed or not.

In the above-described embodiment, explanations have been given such that the signal is continuously output for a predetermine time to the supply valve 106 to cause continuous expansion, but it is not limited to this, for example, the signal may be intermittently output at predetermined time intervals to the supply valve 106 to cause stepwise expansion.

The control of the supply valve 106 when pressurizing the conveyance article by the pump unit 10 is not limited to the time, but the control may be performed on the basis of the pressure detected by the pressing force measuring means 214 or the volume of the conveyance article calculated by the volume calculating means 222.

Figure 4:
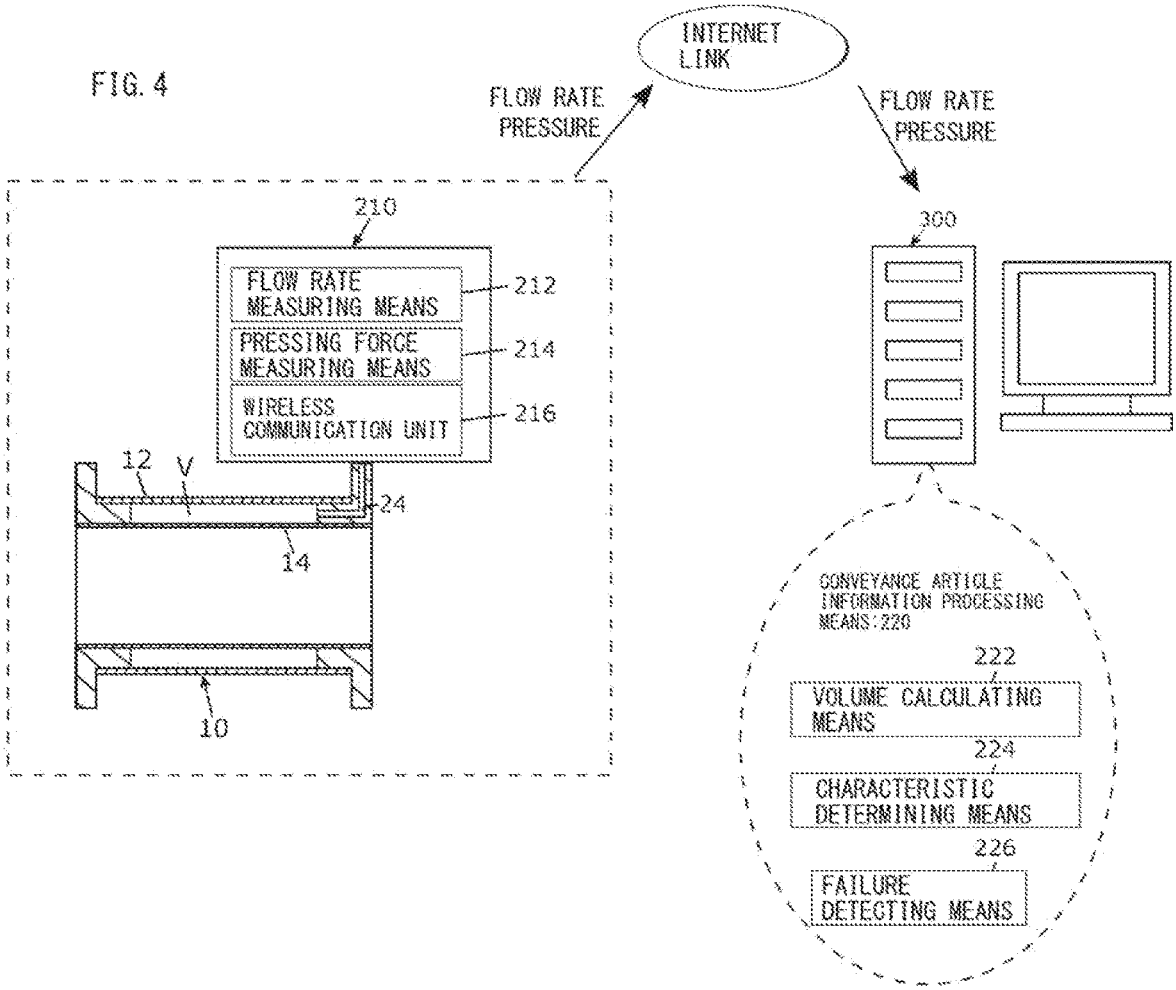
FIG. 4 is a diagram illustrating an example of formation modes of a conveyance article detection device.

FIG. 4 is a diagram illustrating an example of an installation form of the conveyance article detection device 200. The conveyance article detection device 200 described in the above-mentioned embodiment may be configured as follows, for example. In the above-mentioned embodiment, explanations have been given such that the flow rate measuring means 212, which constitutes the conveyance article information acquiring means 210, is provided between the supply valve 106 and the pump unit 10, and the pressing force measuring means 214 is provided between the flow rate measuring means 212 and the pump unit 10, but it is not limited to this.

For example, as illustrated in FIG. 4, for example, it may be configured such that the flow rate measuring means 212 and the pressing force measuring means 214 are integrally provided with the end ring 16 having the supply/discharge section 24, and further a wireless communication means, which is capable of outputting the flow rate measured by the flow rate measuring means 212 and the pressure measured by the pressing force measuring means 214 to the Internet link, may be provided. The power required for the wireless communication device may be supplied to each pump unit 10 via electrical cables along with pipings extending from the drive control device 100.

Then, by setting the function as the conveyance article information processing means 220 to a server 300 connected by wired or wireless communication to the network formed by the Internet link and causing the server 300 to process, the operating state of the pump unit 10 can be monitored over the network such as the Internet.

Figure 5:
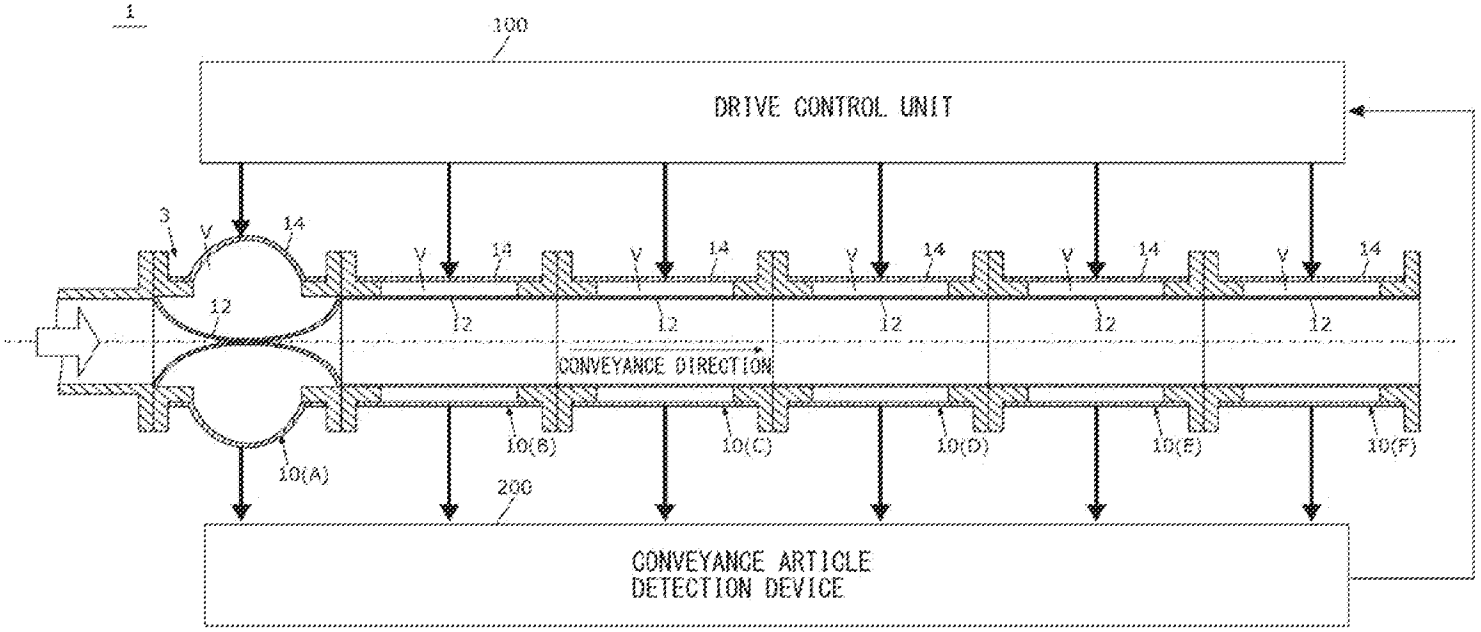
FIG. 5 is a schematic diagram of the pump when multiple pump units are connected to each other.

FIG. 5 is a diagram illustrating a case where plural pump units 10 are connected in the pump 1 having the configuration illustrated in FIG. 1. In FIG. 5, the shaper ring 30 is omitted. As illustrated in FIG. 5, in the case where the multiple pump units 10 are connected to configure the pump 1, the supply valve 106 and the discharge valve 108, which constitute the drive control device 100, are provided for each pump unit 10. The supply valve 106 is connected to the regulator 104 individually so that the pressurizing medium regulated by the regulator 104 is distributed respectively. In addition, each supply valve 106 and each discharge valve 108 are connected to the supply/discharge control unit 110, and supply and stoppage of the pressurizing medium to the corresponding pump unit 10 is controlled by the output of the signal from the supply/discharge control unit 110.

Furthermore, the flow rate measuring means 212 and the pressing force measuring means 214 are provided in each pump unit 10, and calculation of the volume of the conveyance article by the volume calculating means 222, determination of the characteristics of the conveyance article in the pump unit 10 by the characteristic discriminating means 224 and detection of the failure of the pimp unit 10 by the failure detecting means 226, which are of the conveyance article information processing means 220, are executed for each pump unit 10.

As described above, in the case where the plural pump units 10 are connected, the supply/discharge control unit 110 controls the supply valve 106 and the discharge valve 108 which are connected to each pump unit 10, so that the expansion and the contraction of the pump unit 10 move, for example, like the peristaltic motion of intestines, sequentially from the upstream side towards the downstream side in the conveyance direction.

An explanation will be given as to the conveyance operation of the pump units 10 illustrated in FIG. 5, which are denoted as 10A, 10B, . . . , 10F, and so on from the upstream side to the downstream side in the conveyance direction. For example, the supply/discharge control unit 110 controls the supply valve 106 and the discharge valve 108 provided in each of the pump units 10A to 10F, and causes the pump units 10A to 10F to operate as follows so that the conveyance article can be conveyed.

First, while maintaining the pump units 10B to 10F in the contracted state, expand only the pump unit 10A (Step 1).

Next, after expanding the pump unit 10A, while maintaining the pump units 10C to 10F in the contracted state, contract only the pump unit 10A and expand the pump unit 10B (Step 2).

Next, after expanding the pump unit 10B, while maintaining the pump units 10A and 10D to 10F in the contacted state, contract the pump unit 10B and expand the pump unit 10C (Step 3).

Next, after expanding the pump unit 10C, while maintaining the pump units 10A, 10B, 10E and 10F in the contracted state, contract the pump unit 10C and expand the pump unit 10D (Step 4).

Next, after expanding the pump unit 10D, while maintaining the pump units 10A to 10C and 10F in the contracted state, contract the pump unit 10D and expand the pump unit 10E (Step 5).

Next, after expanding the pump unit 10E, while maintaining the pump units 10A to 10D in the contracted state, contract the pump unit 10E and expand the pump unit 10F (Step 6).

Next, after expanding the pump unit 10F, while maintaining the pump units 10B to 10E in the contracted state, contract the pump unit 10F and expand the pump unit 10A (Step 7).

By repeating the above-mentioned Step 1 to Step 7 as one cycle, the supply/discharge control unit 110 can convey the conveyance article toward the downstream side. In the supply/discharge control unit 110, the control shown in Step 1 to Step 7 of the pump units 10 (A to F) may be stored in the memory means, for example, as an operation pattern 1 or the like.

Further, it is also possible, for example, that the supply/discharge control unit 110 causes the pump units 10A to 10F to operate as follows.

First, while maintaining the pump units 10B to 10F in the contracted state, expand only the pump unit 10A (Step 1).

Next, after expanding the pump unit 10A, while maintaining the pump units 10C to 10 F in the contracted state and the pump unit 10A in the expanded state, expand the pump unit 10B (Step 2).

Next, after expanding the pump unit 10B, while maintaining the pump units 10D to 10 F in the contracted state and the pump unit 10B in the expanded state, contract the pump unit 10A and expand the pump unit 10C (Step 3).

Next, after expanding the pump unit 10C, while maintaining the pump units 10A, 10E and 10F in the contracted state and the pump unit 10C in the expanded state, contract the pump unit 10B and expand the pump unit 10D (Step 4).

Next, after expanding the pump unit 10D while maintaining the pump units 10A, 10B and 10F in the contracted state and the pump unit 10D in the expanded state, contract the pump unit 10C and expand the pump unit 10E (Step 5).

Next, after expanding the pump unit 10E, while maintaining the pump units 10A to 10C in the contracted state and the pump unit 10E in the expanded state, contract the pump unit 10D and expand the pump unit 10F (Step 6).

Next, after expanding the pump unit 10F, while maintaining the pump units 10B to 10D in the contracted state and the pump unit 10F in the expanded state, contract the pump unit 10E and expand the pump unit 10A (Step 7).

Next, after expanding the pump unit 10A, while maintaining the pump units 10C to 10E in the contracted state and the pump unit 10A in the expanded state, contract the pump unit 10F and expand the pump unit 10B (Step 8).

By causing the pump units 10A to 10F to repeat the above operation pattern, the conveyance article in the inner cylinder 14 of the pump unit 10 is pressure-conveyed sequentially toward the downstream side due to the expansion of the inner cylinder 14, hence the supply/discharge control unit 110 can convey the conveyance article (Step 9).

By repeating the above-mentioned Step 1 to Step 9 as one cycle, the supply/discharge control unit 110 can convey the conveyance article toward the downstream side. In the supply/discharge control unit 110, the control shown in Step 1 to Step 9 of the pump units 10 (A to F) may be stored in the memory means, for example. as an operation pattern 2 together with the above-mentioned operation pattern 1.

The operations of the pump units 10A to 10F are not limited to the above-mentioned operation patterns 1 and 2, but another operation pattern that enables conveyance of the conveyance article by the pump units 10A to 10F may be stored in the memory means of the supply/discharge control unit 110.

Figure 6:
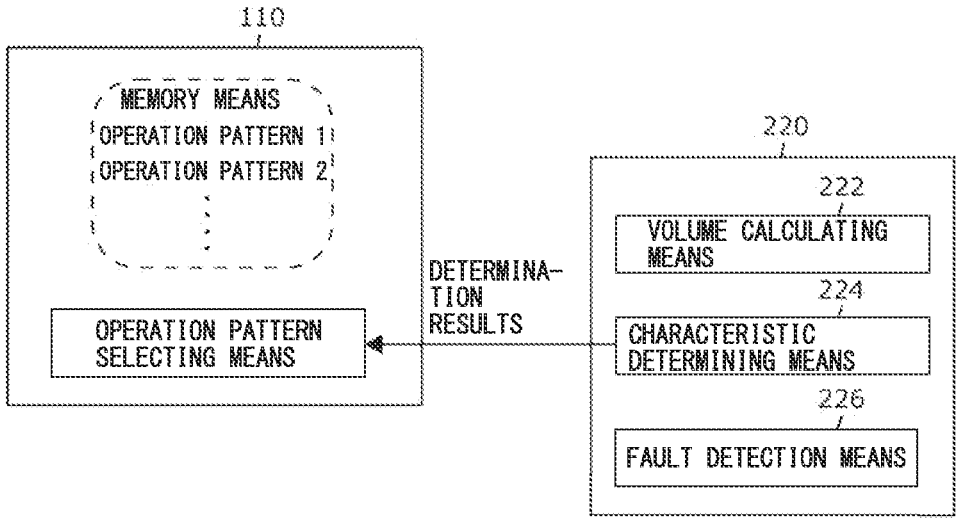
FIG. 6 is a diagram illustrating an example of the configuration of a supply/discharge control unit.

FIG. 6 is a diagram illustrating an example of the configuration of the supply/discharge control unit 110 when plural operation patterns are stored in the supply/discharge control unit 110. As illustrated in FIG. 6, in the case where the plural operation patters are stored in the memory means of the supply/discharge control unit 110, it is preferable to configure to select an operation pattern on the basis of the result of determination by the characteristic determining means 224.

For example, it nay lie configured that the conveyance article information processing means 220 and the supply/discharge control unit 110 are electrically connected so as to be able to output the result of determination by the characteristic determining means 224 to the supply/discharge control unit 110. Furthermore, a program, which causes the supply/discharge control unit 110 to function as an operation pattern selecting means that selects an operation pattern being associated with the characteristics of the conveyance article and corresponding to the determination result, may be stored in the memory means of the supply/discharge control unit 110.

That is, because each of the pump units 10A to 10F is provided with the flow rate measuring means 212 and the pressing force measuring means 214, and the characteristics of the conveyance article are detected for each of the pump units 10A to 10F, by immediately outputting the determination result obtained by the characteristic determining means 224 to the drive control device 100, even in a case where, for example, conveyance articles having different characteristics are mixedly conveyed and the state of the conveyance article changes in the connected pump units 10A to 10F, the conveyance article can be conveyed without degrading the conveyance efficiency.

In the above-described embodiment, the explanation has been given such that the pump units 10A to 10F connected as illustrated in FIG. 5 perform the predetermined operation pattern on the basis of the program stored in the memory means of the supply/discharge control unit 110, but it is not limited thereto.

For example, it may be configured to store a program which, when an abnormal conveyance is detected in either one of the pump units during the period in which the pump units 10A to 10F are in operation of the predetermined operation pattern (hereinafter referred to as "basic operation"), causes another pump unit to operate, as an interrupting processing, that another pump unit being suitable to resolve the conveyance abnormality of the pump unit in which the abnormality was detected. Namely, the program, which causes the supply/discharge control unit 110 to function as a conveyance abnormality resolving means, may be stored in the memory means. And, after the conveyance abnormality was resolved, the pump unit may be caused to execute the basic operation again.

Figure 7:
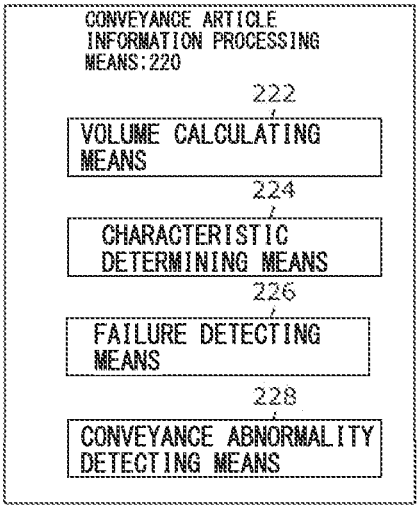
FIG. 7 is a diagram illustrating another form of the conveyance article information processing means.

FIG. 7 is a diagram illustrating another form of the conveyance article information processing means 220. A conveyance abnormality detecting means 228, which detects whether or not the conveyance article is normally conveyed, when the plural pump units 10A to 10F are connected as illustrated in FIG. 5, may be provided in each of the pump units 10A to 10F.

The conveyance abnormality detecting means 228 can compare, for example, the volume of the conveyance article calculated in each of the pump units 10A-10F, and detect a conveyance abnormality such as clogging or the like, in a case where the volume is reduced more than a threshold value from the upstream side to the downstream side in one cycle, or in a case where the volume of a pump unit 10 in the midway is greater than the volumes of pump units 10 before and after the pump unit in the midway.

Further, because the failure detecting means 226 detects the failure of each of the pump units 10A to 10F, the failure detecting means 226 can immediately grasp whether the conveyance abnormality detected by the conveyance failure detecting means 228 is caused by the failure of the pump unit 10, or caused by the characteristics of the conveyance article.

Furthermore, it is preferable, by connecting the pump units 10 as illustrated in FIG. 5 and configuring each of the connected pump units as illustrated in FIG. 4, to store, as an operation history, in the memory means of the server 300 for each of the pump units, the flow rate and the pressure input to the server 300 for each of the pump units 10, the volume calculated by the volume calculating means 222 of the sever 300, and the characteristics of the conveyance article determined by the characteristic determining means 224.

The operation history stored in the server 300 may be stored in association with a unit of one pump which is configured by the connected pump units, and further, the palace where the pump 1 is disposed and the information on the conveyance article and so on may be stored in association with the pump 1 in the sever 300.

Then, by aggregating the above-mentioned information from pumps 1 used in different locations to the sever 300 and, for example, by machine-learning the aggregated information, an operation pattern according to the conveyance article or a conveyance abnormality that is occurrable due to the conveyance article can be predicted. Thereby, it becomes possible to improve the conveyance efficiency and avoid the conveyance abnormality, hence the reliability of pump 1 can be improved.

In the case where each of the pump units 10 is provided with the wireless communication device as illustrated in FIG. 4, the function of the supply/discharge control unit 110 may be separated from the drive control device 100 and provided to each of the pump units 10 to thereby allow each of the pump units 10 to control the operation individually. For example, by providing the pump unit 10 with the supply/discharge control unit 110, the conveyance article detection device 200, the supply valve 106 and the discharge valve 108 together with the wireless communication unit, and by connecting the tube extending from the regulator 104 with the electric power supplied to the supply/discharge control unit 110, the conveyance article detection device 200, the wireless communication unit, the supply valve 106 and the discharge valve 108, the pump unit 10 may be made operable. In other words, one pump unit 10 may be configured as a so-called IoT device. In this case, each of the pump units 10 may be configured such that the supply/discharge control unit 110 thereof allows the communications among the pump units 10 in addition to the communication with the server 300 and, on the basis of the communications among the pump units 10, performs the basic operation of the conveyance described above, the operation of the time when the failure was detected, the operation for resolving the conveyance abnormality, and the operations corresponding to the characteristics of the conveyance article, and so on.

In this way, in the case where the pump unit 10 is provided with the function of the supply/discharge control unit 110 and the function of the conveyance article detection device 200, it is possible to utilize a one-chip microcomputer in which the CPU, the memory means and the communication means functioning as the wireless communication unit are integrated into one.

Further, by exchanging or sharing, among the pump units 10, the information on the conveyance article acquired by the conveyance article information acquiring means of each of the pimp units 10, and by storing, in the memory means of the one-chip microcomputer, the program that causes each of the pump units 10 to perform the conveyance operation of the conveyance article independently, the operation of the time when the failure was detected, the operation for resolving the detected abnormality, and the operations of the plural pump units corresponding to the characteristics of the conveyance article, the pump unit 10 is allowed to operate independently without using the server 300.

In this case, by providing the conveyance article information processing means with the function for selecting, on the basis of the acquired information on the conveyance article, control of the operation for resolving the abnormality of the plural the pump units 10, or control of the operations, which are based on the determined characteristics of the conveyance article, of the plural pump units 10, and by configuring so that the selected content is output to the supply/discharge control unit, it is possible to further automize the operation of the pump 1.

As described above, by detecting the characteristics of the conveyance article conveyed by the pump unit 10 and, on the basis of the detected characteristics of the conveyance article, by causing the pump unit to perform the basic operation of conveyance, the operation of the time when the failure was detected, the operation for resolving the conveyance abnormality and the operation corresponding to the characteristics of the conveyance article, the conveyance of the conveyance article can be optimized and thus the conveyance can be performed effectively.

The configuration of the pump 1 described above is one example, and the places where the means provided in the supply/discharge control unit 110 and the means provided in the conveyance article detection device 200 are to be disposed may be suitably changed to the pump unit 10, the drive control device 100, the server 300 or the like.

Figure 8:
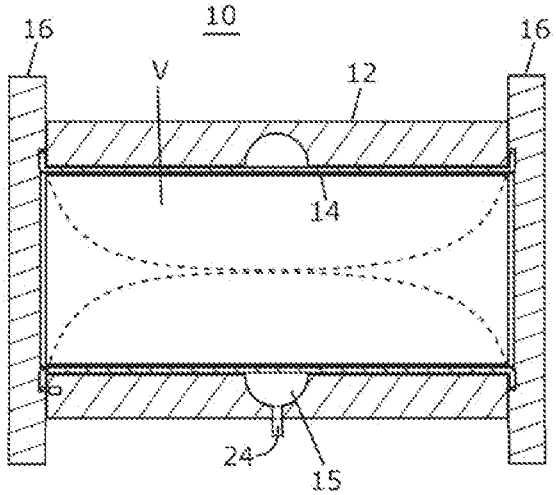
FIG. 8 is a diagram illustrating another form of the pump unit.

FIG. 8 is a diagram illustrating another form of the pump unit 10. In the above-described embodiment, the outer cylinder 12 configuring the pump unit 10 is configured by an elastic member and configured to be expandable together with the inner cylinder 14. However, as illustrated in FIG. 8, the outer cylinder 12 may be configured by a hard resin or the like that does not expand in the radial direction. In the pump unit 10 illustrated in FIG. 8, the inner cylinder 14 is provided to go along with the inner circumferential surface of the outer cylinder 12. On the inner circumferential surface of the outer cylinder 12, a groove 15 is formed, which is depressed all around along the circumferential direction and functions as a pressure supply chamber. By supplying the pressurizing medium to the groove 15 from the supply/discharge section 24 that penetrates the outer cylinder 12, the inner cylinder 14 expands in the centripetal direction, as shown by the dashed line in the figure. Even if the pump unit 10 is configured in this way, it is possible to pressurize the conveyance article in the inner cylinder 14 by the inner cylinder 14 and convey the conveyance article.

Figure 9A:
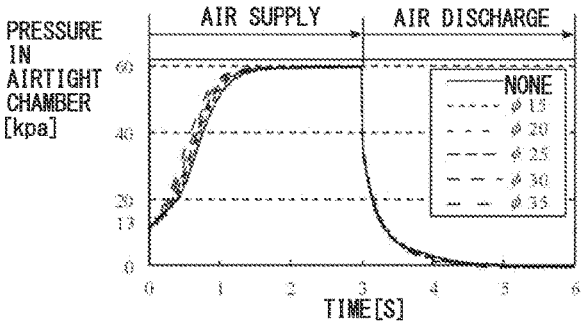
FIGS. 9A to 9C are graphs showing results of evaluation experiments.
Figure 9B:
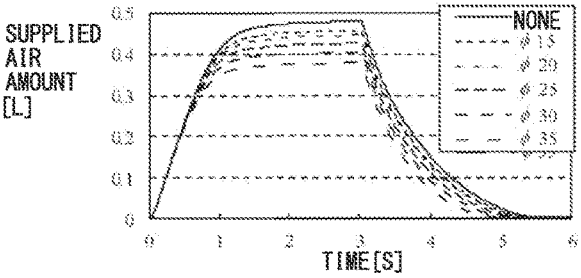
Figure 9C:
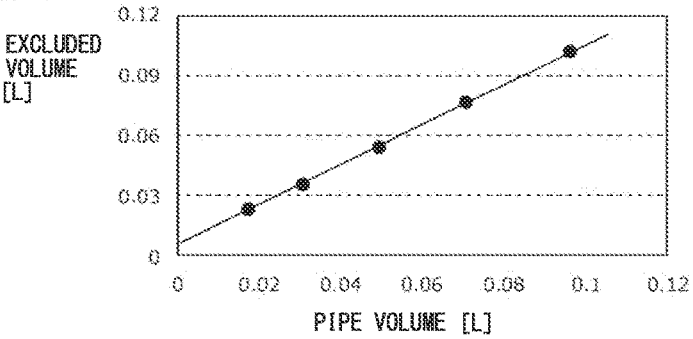

FIGS. 9A to 9C are graphs showing test results of the evaluation test for measuring the flow rate supplied to the pump unit 10 and the pressure in the pump unit 10 and evaluating the effectiveness of the characteristics of the conveyance article obtained from the measured flow rate and the pressure.

In the evaluation test, as illustrated in FIG. 1, an acrylic pipe, assuming the conveyance article, was inserted into the inner cylinder 14 of one pump unit 10, and the effectiveness of the detection, based on changes in the flow rate of the air and the pressure, of the volume of the conveyance article was evaluated. Five types of acrylic pipes with outer diameters of 15 mm, 20 mm, 25 mm, 30 mm and 35 mm were prepared, and influence on the volume detection was examined for each of the acrylic pipes. The differences in the outer diameter were set to reproduce differences in the magnitude of the viscosity of the conveyance article and differences of the characteristics such as the compressibility.

Incidentally, the dimensions of the inner cylinder 14 of the pump unit 10 are such that the inner diameter is 55 mm and the length in the axial direction is 110 mm.

The pressure supplied to the pump unit 10 was regulated by the regulator 104 to 60 kPa, the supply valve 106 was opened for three (3) seconds and then closed and, at the same time, the discharge valve 108 was opened to discharge the air.

FIG. 9A is a graph showing the change in the pressure in the airtight chamber V. After the start of air supply, in both of a state where the inner cylinder 14 is empty and a state where the acrylic pipe is inserted, the pressure rises up to 13 kPa without delay. This is considered to be that because the air was filled in the airtight chamber V. Thereafter, the pressure rises slowly to 60 kPa which is the pressure to be applied. The larger the outer diameter of the acrylic pipe inserted is, the faster the rise in the pressure in the airtight chamber V becomes. This is considered to be that because the larger the outer diameter of the acrylic pipe is, the faster the surface of the inner cylinder 14 comes in contact with the rigid body, the expansion of the inner cylinder 14 is suppressed and the pressure in the airtight chamber V rises up.

FIG. 9B is a graph showing the amount of air supplied to the airtight chamber V, measured by the flow rate sensor. The larger the diameter of the acrylic pipe is, the smaller the amount of supplied air becomes. This is considered to be that because the larger the diameter of the acrylic pipe is, the more the expansion of the inner cylinder 14 is suppressed.

FIG. 9C is a graph showing a correlation of the excluded volume calculated from the comparison between the volume of the acrylic pipe and the empty state of the inner cylinder 14. As a result of performing linear approximation for the plotted points, a strong positive correlation of 0.9987 was confirmed. In other words, the excluded volume conforms to the increase in the thickness of the acrylic pipe inserted into the inner cylinder 14. Therefore, it was confirmed that the volume of the conveyance article in the pump unit 10 can be detected by measuring the flow rate of compressed air supplied to the airtight chamber V.

Accordingly, by detecting the volume of the conveyance article on the basis of the measured flow rate and the pressure and performing the method for detecting the characteristics of the conveyance article, for examining the change of the volume when the inner cylinder 14 was in the maximum expansion or until the expansion of the inner cylinder 14 reaches the maximum, the characteristics of the conveyance article such as the viscosity, hardness and so on can be known.

REFERENCE SIGN LIST

1: Pump, 10 (A-F): Pump unit, 12: Outer cylinder. 14: Inner cylinder, 16: End ring, 24: Supply/discharge section, 30: Shaper ring, 100: Drive control device, 102: Pressurizing medium supply unit, 104: Regulator, 106: Supply valve, 108: Discharge valve, 110: Supply/discharge control unit, 200: Conveyance article detection device, 210: Conveyance article information acquiring means, 212: Flow rate measuring means, 214: Pressing force measuring means, 220: Conveyance article information processing means, 222: Volume calculating means, 224: Characteristic determining means, 226: Failure detecting means, 228: Conveyance abnormality detecting means; V: Airtight chamber.

The invention claimed is:

1. A pump provided with a pump unit, the A pump unit comprising:

an outer cylinder;

an inner cylinder disposed on an inner circumference side of the outer cylinder; and a pressure supply chamber provided between the inner cylinder and the outer cylinder, the pump unit being configured to convey a conveyance article in the inner cylinder by supplying a pressurizing medium into the pressure supply chamber and thereby causing the inner cylinder to expand inwardly in a radial direction, wherein the pump further comprises a conveyance article information acquiring means configured to acquire information on the conveyance article in the inner cylinder at a time when the inner cylinder is expanded, and wherein the conveyance article information acquiring means comprises:

a flow rate measuring means configured to measure a flow rate of the pressurizing medium to be supplied to the pressure supply chamber, and a pressure measuring means configured to measure a pressing force of the inner cylinder pressing the conveyance article caused by supply of the pressurizing medium to the pressure supply chamber, the pump further comprising:

a supply/discharge control means configured to control supply and discharge of the pressurizing medium to and from the pump unit; and a conveyance article information processing means including:

a volume calculating means configured to calculate a volume of the conveyance article in the inner cylinder on the basis of the flow rate of the pressurizing medium measured by the flow rate measuring means and the pressure of the inner cylinder pressurizing the conveyance article, which is measured by the pressing force measuring means; and a characteristic determining means configured to determine characteristics of the conveyance article on the basis of the volume calculated by the volume calculating means.

2. The pump according to claim 1, wherein the pump comprises a conveyance abnormality detecting means configured to detect a conveyance abnormality on the basis of the information on the conveyance article acquired by the conveyance article information acquiring means.

3. The pump according to claim 2, wherein the supply/discharge control means controls operations of a plurality of pump units, on the basis of the conveyance abnormality detected by the conveyance abnormality detecting means, so as to resolve the detected abnormality.

4. The pump according to claim 1, wherein the supply/discharge control means controls operations of a plurality of pump units, on the basis of the characteristics of the conveyance article determined by the conveyance article information processing means.

5. The pump according to claim 4, wherein the conveyance article information processing means selects, on the basis of information on the conveyance article to be input from the conveyance article information acquiring means provided in each pump unit, control by the supply/discharge control means of operations for resolving abnormality of the plurality of pump units, or control of operations, based on the determined characteristics of the conveyance article, of the plurality of pump units, and outputs the selection to the supply/discharge control means.

6. A method for detecting characteristics of a conveyance article conveyed by a pump unit which comprises:

an outer cylinder;

an inner cylinder disposed on an inner circumference side of the outer cylinder; and a pressure supply chamber provided between the inner cylinder and the outer cylinder, the pump unit being configured to convey the conveyance article in the inner cylinder by supplying a pressurizing medium into the pressure supply chamber and thereby causing the inner cylinder to expand inwardly in a radial direction, the method comprising:

calculating a volume of the conveyance article in the inner cylinder at a time when the inner cylinder is expanded on the basis of a pressure of the inner cylinder pressurizing the conveyance article and a flow rate of the pressurizing medium supplied to the pressure supply chamber, and detecting the characteristics of the conveyance article on the basis of the calculated volume.

7. The pump according to claim 1, wherein the characteristic determining means is capable of determining both of or either one of viscosity and hardness of the conveyance article, the characteristic determining means being configured to determine the viscosity on the basis of volume change over time, and determine the hardness on the basis of the volume change over time and change of the pressure.

8. The pump according to claim 1, wherein the conveyance article information processing means comprises a failure detecting means configured to detect a failure of the pump unit on the basis of the flow rate and the pressure, and is capable of detecting the failure as air leak is occurring in the pump unit, in a case where the pressure does not increase along with increase in the flow rate.

9. The method according to claim 6, wherein the characteristics of the conveyance article include both of or either of viscosity and hardness, wherein the method includes:

detecting the viscosity on the basis of volume change over time of the conveyance article, and detecting the hardness on the basis of the volume change over time of the conveyance article and the change of the pressure.

* * * * *